US008845032B2

(12) United States Patent
Bruce et al.

(10) Patent No.: US 8,845,032 B2
(45) Date of Patent: Sep. 30, 2014

(54) RESTRAINING DEVICE FOR A CAR SEAT HARNESS SHOULDER STRAP

(76) Inventors: Ashley Renee Bruce, San Diego, CA (US); Dylan Stewart Bruce, San Diego, CA (US); Patricia Laine Hoehne, Cameron Park, CA (US)

( * ) Notice: Subject to any disclaimer, the term of this patent is extended or adjusted under 35 U.S.C. 154(b) by 480 days.

(21) Appl. No.: 13/116,905

(22) Filed: May 26, 2011

(65) Prior Publication Data

US 2011/0291459 A1 Dec. 1, 2011

Related U.S. Application Data

(60) Provisional application No. 61/348,960, filed on May 27, 2010.

(51) Int. Cl.
*A47D 15/00* (2006.01)

(52) U.S. Cl.
CPC ..... *A47D 15/006* (2013.01)
USPC ..... 297/483; 297/250.1; 24/301

(58) Field of Classification Search
USPC ..... 297/483, 484; 24/3.13, 17 B, 300, 301, 24/306, 30.5 R, DIG. 29
See application file for complete search history.

(56) References Cited

U.S. PATENT DOCUMENTS 3,125,375 A * 3/1964 Bird ..... 297/465
3,567,247 A * 3/1971 Sobkow et al. ..... 280/808
3,947,927 A * 4/1976 Rosenthal ..... 24/306
4,648,625 A * 3/1987 Lynch ..... 280/808
4,946,198 A * 8/1990 Pittore et al. ..... 280/808
5,253,393 A * 10/1993 Levin ..... 24/301
5,308,116 A * 5/1994 Zawisa et al. ..... 280/808
6,880,893 B1 * 4/2005 Scotton ..... 297/485
7,104,570 B2 * 9/2006 Hearn et al. ..... 280/801.1
7,314,235 B2 * 1/2008 Downey ..... 280/808
7,343,647 B1 * 3/2008 Kinskey et al. ..... 24/3.13
7,513,532 B1 * 4/2009 Vaughns et al. ..... 280/808
7,574,881 B1 * 8/2009 Wong et al. ..... 70/456 R
7,805,816 B1 * 10/2010 Thorne et al. ..... 24/301
7,971,908 B2 * 7/2011 Hathaway et al. ..... 280/808
8,235,469 B2 * 8/2012 Meyer ..... 297/483
8,328,289 B2 * 12/2012 Tharp ..... 297/481
8,465,055 B2 * 6/2013 Hill ..... 280/801.1
2002/0158457 A1 * 10/2002 Simmons ..... 280/801.1
2004/0040125 A1 * 3/2004 Schultz ..... 24/306
2005/0179289 A1 * 8/2005 Fuller et al. ..... 297/250.1
2006/0202543 A1 * 9/2006 Meyer ..... 297/483
2010/0005632 A1 * 1/2010 Pigozzi ..... 24/3.13
2012/0183168 A1 * 7/2012 Humes ..... 381/334

* cited by examiner

*Primary Examiner* — David R Dunn
*Assistant Examiner* — Richard Lowry

(57) ABSTRACT

A restraining device eases the loading, unloading and securing of an infant/child to a car seat by holding the shoulder straps of the harness assembly away from the seating area of the car seat. A common, central body is secured to the carrying handle of the infant car seat by at least one of the at least one radial extension. Another of the at least one radial extension is used to secure the harness shoulder strap temporarily to the carrying handle while the infant/child is placed in the seating area of the car seat. The harness shoulder strap is subsequently released from the carrying handle and returned to its original position within the seating area for properly securing the infant/child to the car seat.

8 Claims, 4 Drawing Sheets

RESTRAINING DEVICE FOR A CAR SEAT HARNESS SHOULDER STRAP

CROSS REFERENCES

This application claims priority from U.S. Provisional Patent Application Ser. No. 61/348,960 filed May 27, 2010 incorporated herein in its entirety by this reference.

FIELD OF INVENTION

The present invention relates generally to the field of fasteners. More particularly, but not by way of limitation, the present invention relates to a loop and button restraining device for a car seat harness shoulder strap.

BACKGROUND OF THE INVENTION

Infant car seats are required by law to restrain infants when traveling in moving vehicles. Typically, infant car seats double as an infant carrier and car seat that straps or latches into the rear seat of a vehicle with the infant facing towards the rear of the vehicle. The infant car seats are designed to hold infants measuring about 30 inches and weighing up to 30 lbs. The infant car seat devices generally have a seating surface, back wall, side walls, adjustable carrying handle and harness assembly. The shoulder straps of the harness assembly protrude through slits in the back wall of the infant car seat. Because the harness assembly protrudes through the back wall of the infant car seat, the shoulder straps of the harness assembly are necessarily located underneath the infant when occupied. Thus, when placing the infant in the infant car seat, the shoulder straps of the harness assembly must be pulled from underneath the infant before the harness assembly can be properly secured.

When the infant outgrows the infant car seat, he/she moves to a convertible car seat that will accommodate children in a forward facing position up to 40 lbs and with some models accommodating children over 50 lbs. The major difference between the infant and convertible car seat is the lack of a carrying handle on the convertible car seat. The harness assembly configuration, however, is similar to the infant car seat in a convertible car seat; the shoulder straps are located on the back wall of the seating area and must be pulled from underneath the child before the harness assembly can be properly secured. Thus, the need exists for a device to secure the shoulder straps of the harness assembly away from the back wall of the seating surface of the infant and convertible car seat so as to ease the process of loading, unloading and securing an infant/child to the car seat.

The Buckle Pals, Cling 'N Go and Handy Hooks seatbelt strap holder system are the only known products that attempts to address this need. The Cling 'N Go system consists of a seat pad, a left side strap wrap and a right side strap wrap. The seat pad attaches to the back of the infant car seat. The left and right strap wraps use a hook and loop design to hold the seat belts out of the seating area to ease loading and unloading the infant. The Handy Hooks are for use in convertible car seats and consist of moldable bands to secure to the convertible car seat and hooks to hold the seatbelt straps away from the seating area. The Handy Hooks slip up and down the length of the convertible car seat thus making it inconvenient for use. Furthermore, the Cling 'N Go system is an actual addition to the seating area of the infant car seat and may interfere with the proper performance of the car seat.

This invention overcomes the shortcomings of the Buckle Pals, Cling 'N Go system with an easier to use product that provides a safe, simple and less frustrating procedure for loading, unloading and securing an infant/child to the car seat.

SUMMARY OF THE INVENTION

Various exemplary embodiments as described herein address the desirable aspects lacking in the relevant art and provide in various exemplary embodiments a restraining device for the shoulder straps of a harness assembly in a car seat, according to the present invention, comprises a common, central body and at least one radial extension, wherein the common, central body is generally disk shaped. Preferably, the at least one radial extension is made from an elastic material and form loops extending radially from the common, central body. Advantageously located along the length of one of the at least one radial extension is a tab for easing the passage of the at least one radial extension over the common, central body.

In accordance with one aspect of the invention, the common, central body is affixed to the carrying handle of the infant car seat. Preferably, the common, central body is detachably affixed to the carrying handle of the infant car seat by wrapping one of the at least one radial extension around the circumference of the carrying handle and secured thereto by being passed over the head of the common, central body.

In accordance with another aspect of the invention, the shoulder straps of the harness assembly is detachably affixed to the carrying handle by wrapping one of the at least one radial extension around the circumference of the shoulder strap of the harness assembly and by being passed over the head of the common, central body thus securing the shoulder strap away from the back wall of the seating area of the infant car seat. Preferably, the shoulder strap of the harness assembly will be returned to its appropriate location for properly securing the infant to the infant car seat by pulling on the tab located along the length of one of the at least one radial extension and releasing from the common, central body by passing over the head of the common, central body so as to return the at least one radial extension to its original position.

As another aspect of the invention, when the infant car seat is occupied, the at least one radial extension may be removed from reach of the infant by wrapping around the circumference of the carrying handle and secured thereto by being passed over the head of the common, central body.

As another aspect of the invention, when used in a convertible car seat, which has a different point of attachment due to the lack of a carrying handle, the at least one radial extension point of attachment will vary depending upon the manufacturer and model of the convertible car seat. Due to the flexibility of the at least one radial extension, most models will accommodate use of the invention to secure the shoulder straps of the harness assembly away from the seating area of the convertible car seat.

Yet another aspect of the invention includes a method for restraining the shoulder straps of a harness assembly away from the back wall of a seating device, comprising the steps of using at least one radial extension to detachably affix a central body to a surface of a device selected from at least one member of the group consisting of an infant car seat, convertible car seat, booster seat, high chair and devices containing harness assemblies; and using at least one radial extension to temporarily restrain the shoulder straps of the harness assembly.

The described fastening device thus effectively simplifies and eases the loading, unloading and securing of an infant/child in the infant and convertible car seat for travel in a moving vehicle by conveniently removing the shoulder straps of the harness assembly from the back wall of the infant and convertible car seat.

It is contemplated that any method, system or information described herein can be implemented with respect to any other method, system or information described herein.

Unless otherwise defined, all terms used herein have the same meaning as commonly understood by one of ordinary skill in the art to which this invention belongs. Methods and materials are described herein for use of the present invention; other suitable methods and materials known in the art can also be used. The materials and methods, and examples are illustrative only and not intended to be limiting. All publications, patent applications, patents and other references mentioned herein, are incorporated by reference in their entirety. In case of conflict, the present specification, including definitions will control.

These, and other, embodiments of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

BRIEF DESCRIPTION OF THE FIGURES

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF THE INVENTION

Figure 1:
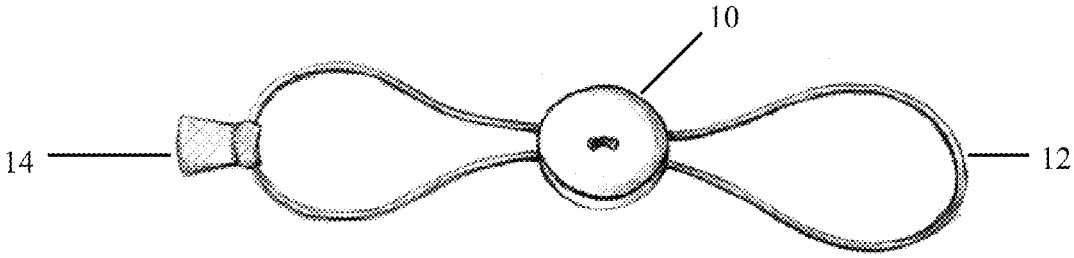
FIG. 1 is a perspective view of the present invention.
Figures 2, 3:
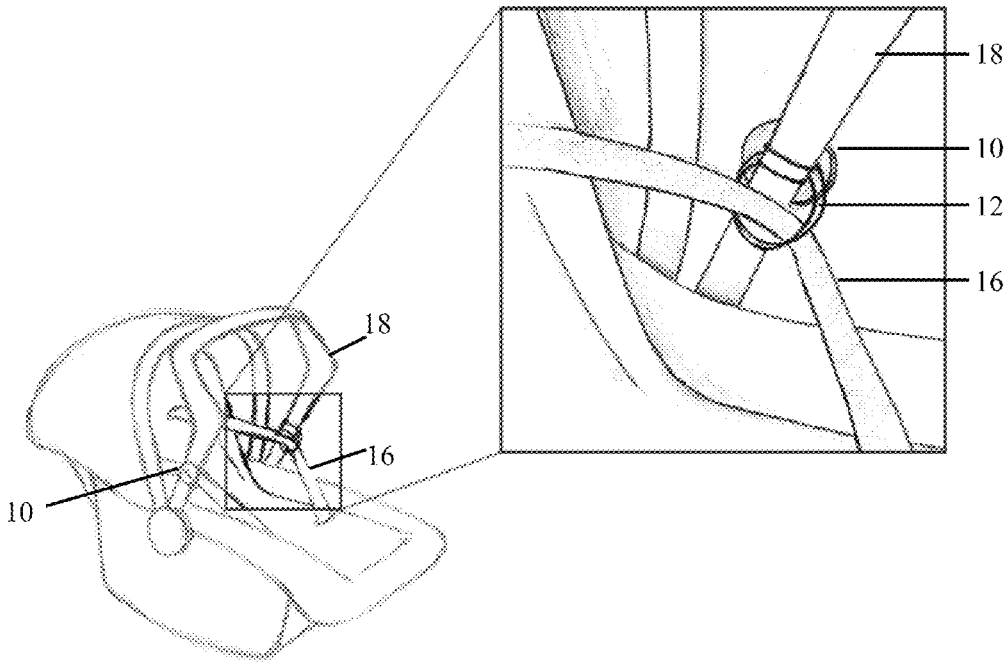
FIG. 2 is a perspective view of the present invention, showing the invention as it is used to secure the shoulder strap of the harness assembly to the carrying handle away from the seating area of the infant car seat.
FIG. 3 is a magnified cutaway of FIG. 2, showing an enlarged view of the present invention as it is used to secure the shoulder strap of the harness assembly to the carrying handle away from the seating area of the infant car seat.

Referring now to the drawings, and more particularly to FIGS. 1 and 2, the perspective view of the invention in FIG. 1 shows the common, central body 10 with the at least one radial extension 12. The common, central body 10 is preferably disc shaped and formed from plastic, metal, rubber or other suitable material. The at least one radial extension 12 forms loops and are preferably made from an elastic material of sufficient length and elasticity to be passed around the circumference of the carrying handle 18, FIG. 2, and harness shoulder strap 16, FIG. 2, and over the head of the common, central body 10. Alternatively, the at least one radial extension 12 can be made of Velcro® or any other suitable material sufficient to secure the common, central body 10 to the carrying handle 18 and restrain the harness shoulder strap 16 away from the seating are of the car seat. The at least one radial extension 12 are formed by joining two points of a single, circular body of elastic material to the common, central body 10. Methods of joining suitable materials of the at least one radial extension 12 to the common, central 10 are well known to one of ordinary skill in the art and will vary depending on the choice of materials used to construct the common, central body 10 and the at least one radial extension 12.

The at least one radial extension 12 are movable in relation to the common, central body 10. This permits adjustment in the size of the radial loop extensions 12 in relation to each other so as to accommodate varying circumferences of the carrying handle 18, FIG. 2, and harness shoulder straps 16, FIG. 2. A tab 14 is located along the length of at least one of the at least one radial extension 12. The tab 14 eases the passage of the at least one radial extension 12 over the common, central body 10 when securing and unsecuring the shoulder strap of the harness assembly 16 to the carrying handle 18.

Referring now to FIG. 3, the magnified cutaway shows the invention as it is used to secure the harness shoulder strap 16 to the carrying handle 18. To accomplish this, one of the at least one radial extension 12, detachably affixes the common, central body 10 to the carrying handle 18 of the infant car seat. Another of the at least one radial extension 12 secures the shoulder strap of the harness assembly 16 away from the seating area of the infant car seat. It is preferable to use the at least one radial extension 12 containing the tab (not shown) for securing the shoulder strap of the harness assembly 16 to the carrying handle 18. Thus, by simply pulling the tab (not shown), the harness shoulder strap 16 can be released from the carrying handle 18 and returned to its original position in the seating area for securing the infant/child to the car seat. This ensures ease of use when loading, unloading and securing the infant to the infant car seat.

Figure 4:
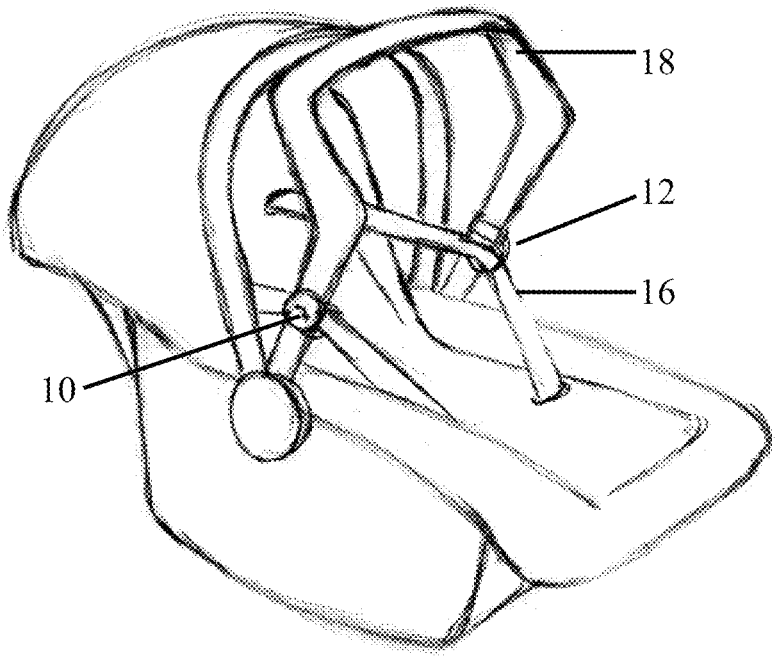
FIG. 4 is a view similar the FIG. 2, but showing an enlarged view of the present invention as it is used to secure both shoulder straps of the harness assembly to the carrying handle away from the seating area of the infant car seat.

Referring now to FIG. 4, shown is a perspective view of a pair of the fasteners as are required to secure each of the shoulder straps of the harness assembly 16 to the carrying handle 18 of the infant car seat.

Figure 5:
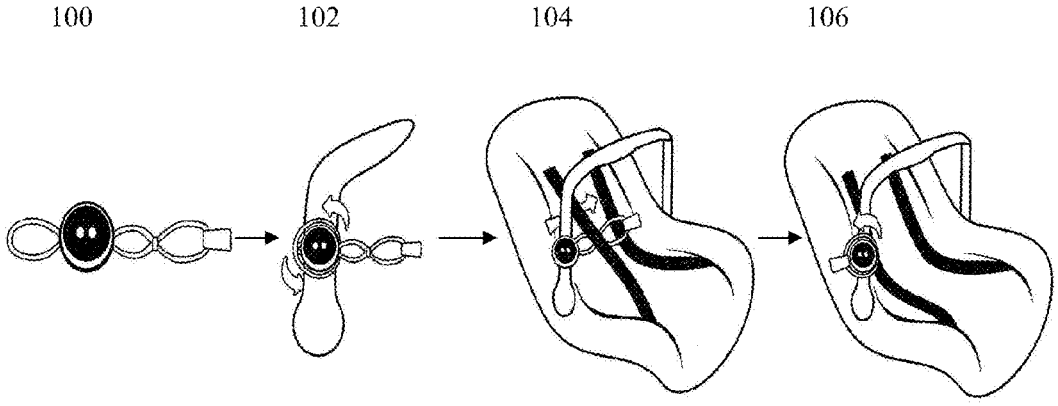
FIG. 5 is a flow diagram illustrating the method of restraining the shoulder strap of the harness assembly.

Referring now to FIG. 5 demonstrating a flow diagram of the method of restraining the shoulder straps of the harness assembly away from the seating area of a seating device. At 100, the preferred embodiment of the present invention is shown before attachment to the carrying handle of a car seat. At 102, the central body is detachably affixed to the carrying handle by wrapping the at least one radial extension around the circumference of the carrying handle and joining to the central body. At 104, the shoulder strap of the harness assembly is restrained from the seating area of the car seat by wrapping the at least one radial extension around the shoulder strap and joining to the central body at 106.

It is contemplated by the present disclosure that the invention may be used with any number of varying seating devices containing harness assemblies that include shoulder straps. It is well known that several infant and children seating devices include similar harness assemblies that would benefit from the novel aspects of the present invention including but not limited to convertible car seats, booster seats, high chairs and the like.

While this invention has been particularly shown and described with references to preferred embodiments thereof, it will be understood by those skilled in the art that various changes in form and details may be made therein without departing from the scope of the invention encompassed by the appended claims.

The inventions illustratively described herein can suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the future shown and described or any portion thereof, and it is recognized that various modifications are possible within the scope of the invention claimed. Thus, it should be understood that although the present invention has been specifically disclosed by preferred embodiments and optional features, modification and variation of the inventions herein disclosed can be resorted by those skilled in the art, and that such modifications and variations are considered to be within the scope of the inventions disclosed herein. The inventions have been described broadly and generically herein. Each of the narrower species and subgeneric groupings falling within the scope of the generic disclosure also form part of these inventions. This includes the generic description of each invention with a proviso or negative limitation removing any subject matter from the genus, regardless of whether or not the excised materials specifically resided therein.

In addition, where features or aspects of an invention are described in terms of the Markush group, those schooled in the art will recognize that the invention is also thereby described in terms of any individual member or subgroup of members of the Markush group. It is also to be understood that the above description is intended to be illustrative and not restrictive. Many embodiments will be apparent to those of ordinary skill in the art from consideration of the specification and practice of the invention disclosed herein. It is intended that the specification and examples be considered as exemplary only, with a true scope and spirit of the invention being indicated by the claims along with the full scope of equivalents to which such claims are entitled. The disclosures of all articles and references, including patent publications, are incorporated herein by reference.

What is claimed:

1. A combination of a car seat and a harness restraint, wherein the harness restraint comprises:

a first radial extension, a second radial extension, and a central body;

wherein the first radial extension is wrapped around a carry handle of the car seat, and then around the perimeter of the central body, affixing the harnass restraint to the carry handle; and the second radial extension is subsequently wrapped around a car seat harness strap, and then around the perimeter of the central body, affixing the car seat harness strap close to the carry handle and away from a centered seating portion of the car seat.

2. The restraining device of claim 1, wherein the central body is disk-shaped.

3. The restraining device of claim 1, wherein the first and second radial extensions form at least one loop.

4. The restraining device of claim 3, wherein the first and second radial extensions are formed from a material selected from at least one member of the group consisting of an elastomeric material and hook and loop fasteners.

5. The restraining device of claim 4, wherein the second radial extension further comprises a tab located at its distal end.

6. The restraining device of claim 5, wherein the second radial extension extends further from the central body than the first radial extension.

7. A method of temporarily restraining the shoulder straps of a five-point harness assembly of an infant car seat away from the seating area of the infant car seat, comprising the steps of:

using one of at least two radial extensions to detachably affix a central body to a carrying handle of an infant car seat by wrapping the end of the at least two radial extensions around the circumference of the carrying handle and joining to the central body by wrapping the end of the at least two radial extensions around the perimeter of the central body, affixing the central body to the carry handle; and using another of at least two radial extensions to temporarily restrain the shoulder straps of the harness assembly away from the seating area while loading and unloading an infant or child into and out of the infant car seat by wrapping the other of at least two radial extensions around the shoulder strap of the harness assembly and joining to the central body by wrapping the end of the another of at least two radial extensions around the perimeter of the central body.

8. The method of claim 7, wherein the shoulder straps of the harness assembly are released from the restrained position by pulling a tab located on at least one of the radial extensions thereby disjoining the at least one radial extension from the central body.

* * * * *